US005605232A

United States Patent [19]

Bickle

[11] Patent Number: 5,605,232

[45] Date of Patent: Feb. 25, 1997

[54] DOLL TRANSPORTER

[76] Inventor: Lynn B. Bickle, 2667 San Miguel Cir., Thousand Oaks, Calif. 91360

[21] Appl. No.: 449,803

[22] Filed: May 24, 1995

[51] Int. Cl.[6] ..... B65D 5/50

[52] U.S. Cl. ..... 206/764; 206/754; 206/287; 150/154; 220/668

[58] Field of Search ..... 206/457, 286, 206/287, 756, 764; 150/154; 190/100, 122, 127; 220/668

[56] References Cited

U.S. PATENT DOCUMENTS

| | | | |
|---|---|---|---|
| 450,309 | 4/1891 | Crosson . | |
| 1,490,922 | 4/1924 | Groh . | |
| 1,828,088 | 10/1931 | Robinson | 220/668 |
| 1,846,542 | 2/1932 | Budd . | |
| 2,755,896 | 7/1956 | Breglia | 190/127 |
| 2,968,394 | 1/1961 | Appelt | 206/756 |
| 3,039,599 | 6/1962 | Mintz | 206/287 |
| 3,134,484 | 5/1964 | Cox et al. | 206/287 |
| 3,182,846 | 5/1965 | Kaff | 220/668 |
| 3,406,816 | 10/1968 | Green et al. | 206/756 |
| 3,434,652 | 3/1969 | Shore . | |
| 3,462,067 | 8/1969 | Shore . | |
| 4,502,576 | 3/1985 | Reardon | 206/287 |
| 4,529,069 | 7/1985 | March | 190/127 |
| 4,730,942 | 3/1988 | Fulcher . | |
| 4,905,822 | 3/1990 | Bosco | 220/668 |
| 5,025,925 | 6/1991 | Wiklund . | |
| 5,289,937 | 3/1994 | Boots . | |

FOREIGN PATENT DOCUMENTS

| | | | |
|---|---|---|---|
| 527635 | 11/1956 | Belgium | 150/154 |
| 318828 | 2/1920 | Germany | 150/154 |

*Primary Examiner*—David T. Fidei
*Attorney, Agent, or Firm*—William W. Haefliger

[57] ABSTRACT

In a doll transporter, the combination comprising a cage; structure located to support a doll contained within the cage; and a cover extending protectively about the cage and to be sufficiently removable therefrom as to provide access to the doll, by manipulation of the cage.

14 Claims, 5 Drawing Sheets

DOLL TRANSPORTER

BACKGROUND OF THE INVENTION

This invention relates generally to doll transportation and protection, and more particularly to a doll transporter which provides enclosing, protection for a doll supported as by a doll stand, and allowing ready access to the doll, as desired.

As dolls, such as actual and replica antique dolls, become increasingly handled, i.e. moved about during travel of their owners, there is increasing need for protection of such dolls, which are usually quite fragile. No way was known, to my knowledge, to provide a doll transporter having the many advantages in construction, modes of use, and highly advantageous result as are now provided by the present invention.

SUMMARY OF THE INVENTION

It is a major object of the invention to provide a doll transporter and protector meeting the above need, and also providing additional unusual advantages in construction and modes of use. Basically the transporter comprises:

a) a cage, b) means located to support a doll contained within the cage, c) and a cover extending protectively about the cage and to be sufficiently removable therefrom as to provide access to the doll, by manipulation of the cage.

As will be seen, the manipulable cage may advantageously include laterally spaced, longitudinally elongated members and means holding the ends of said members in fixed position. Also end plates may be provided to interconnect and orient ends of the elongated members, which may be tubular rods.

Another object includes the provision of connectors removably connecting member ends to at least one of said plates. Both plates may be connected to the tubular members, as via such connectors; and the connectors may extend through holes in the plates and into the tubular member ends, in such a way as to be easily removable, to gain access to the cage contained and protected doll. Heads on the connectors are held in position, as by the enclosing cover, which may be flexible, and conform to the cage, as will be seen; also the cage rods and end plates act to fill out or hold the cover in box shape, for example, i.e. in a form that may be easily carried as by a handle.

Another object is to provide doll stand positioning support for the doll within the cage, as by support and cover retention of the doll stand flat base adjacent a flat plate. The doll stand typically has an elongated part carried by the base and extending longitudinally to carry a doll within the cage. Attachment means may be provided to attach that part to the cover, such attachment means for example comprising loops or rings through which the doll stand elongated part projects. This also positions one side of the cover, which lies closest to the protected doll.

A further object includes the provision of sleeves carried by the cover and receiving said members.

Yet another object includes the provision of a cage that includes at least three of the elongated members with ends connected to the plates; and preferably there are four of such members, as will be described. The cover itself may comprise flexible material, such as canvas or the like, and it may define a split portion held closed, or enabled to be opened, as by a zipper, to gain access to the cage for its manipulation to gain access to the contained and protected doll.

A further object is to provide a lightweight, easily transported doll containment assembly, easily opened up to gain access to the doll for removal of the doll and its stand, for display, free of the containment assembly.

These and other objects and advantages of the invention as well as details of an illustrative embodiment, will be more fully understood from the following specification and drawings in which:

DRAWING DESCRIPTION

Figure 7A:
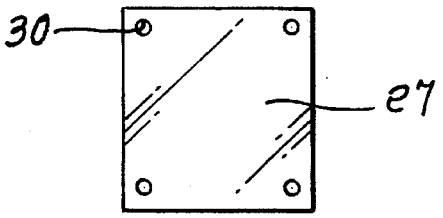
Figure 7B:
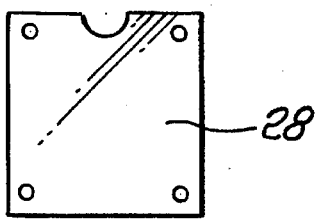
Figure 8:
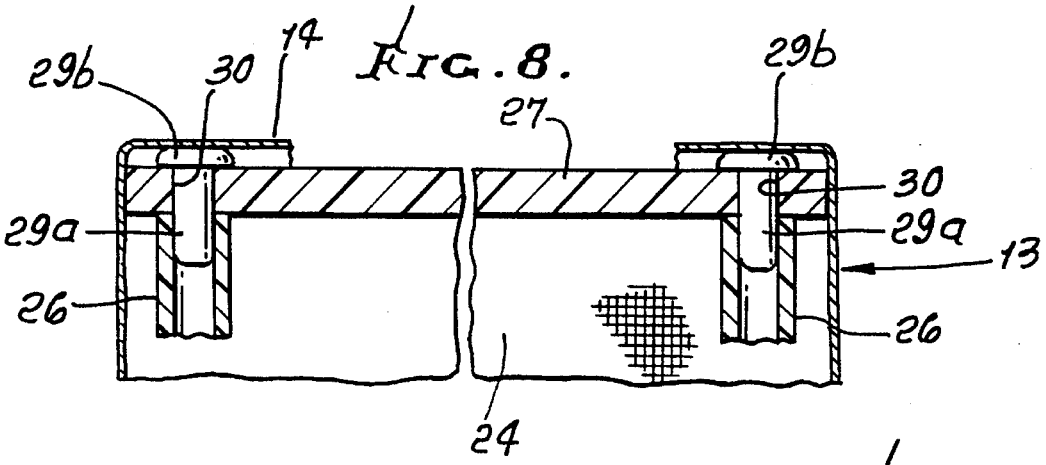
Figure 10:
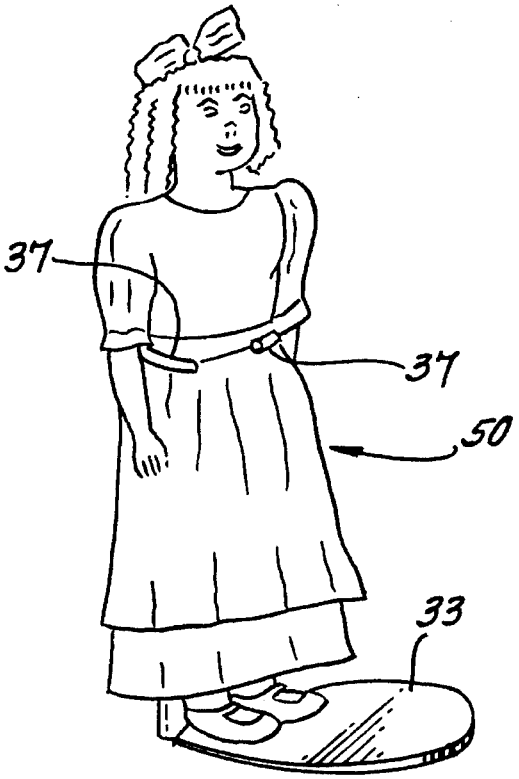
Figure 9:
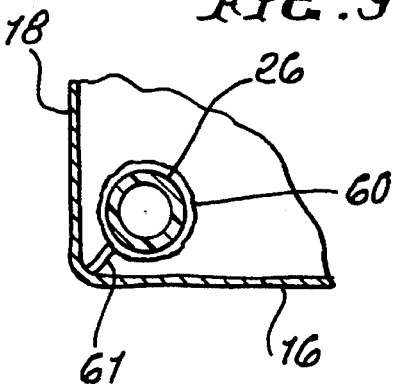
Figure 11:
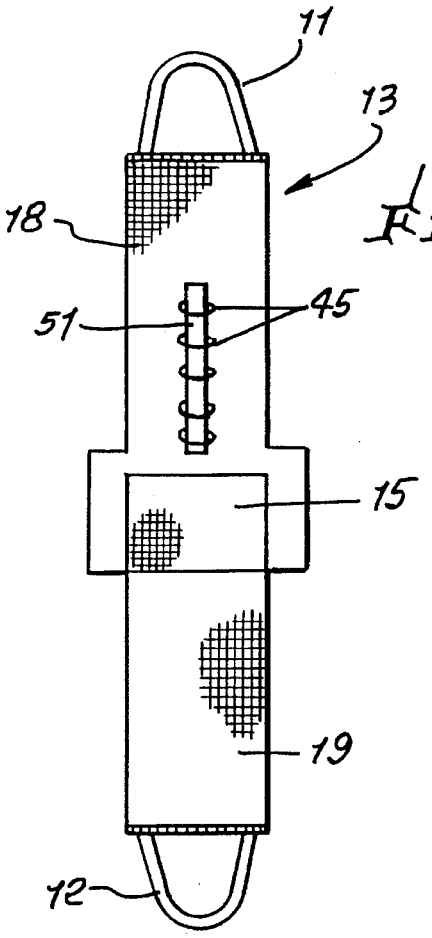

FIGS. 7*a* and 7*b* are top plan views of top and bottom end plates;

FIG. 8 is an enlarged side elevation showing tubular member assembly to an end plate, using plugs;

FIG. 9 is a fragmentary section taken in horizontal section, to show tubular member retention in a cover sleeve, to form a package corner;

FIG. 10 shows a doll on a doll stand;

FIG. 11 shows the cover or jacket removed from the cage; and

Figure 12:
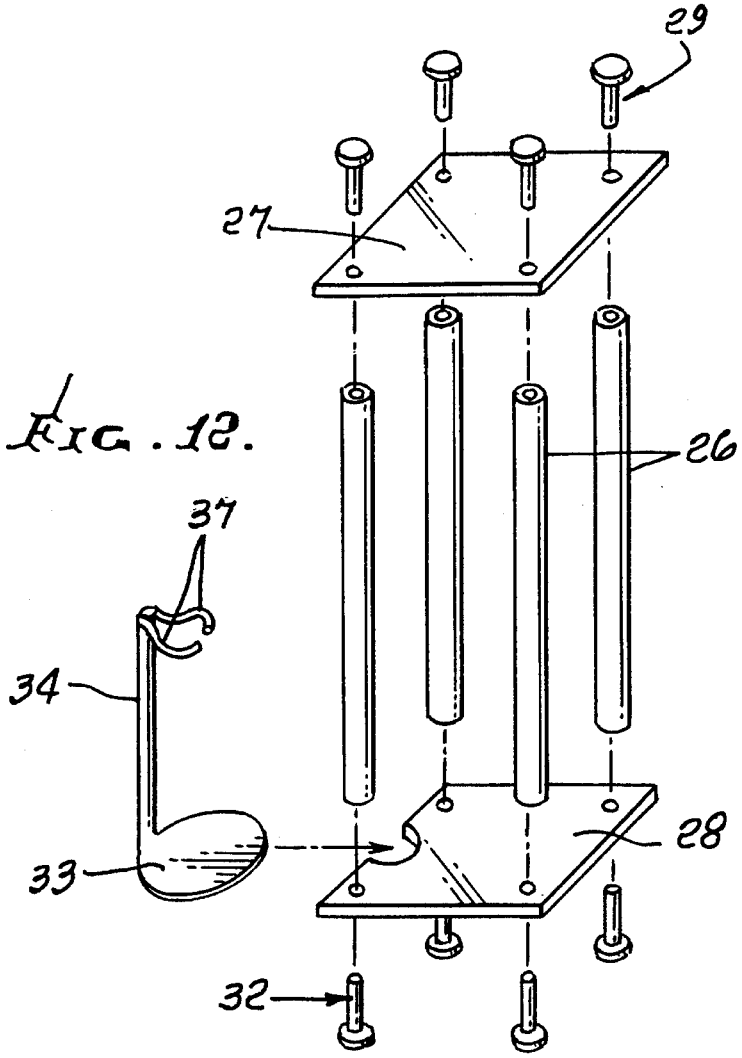

FIG. 12 shows the cage elements in exploded view form.

DETAILED DESCRIPTION

Figure 2:
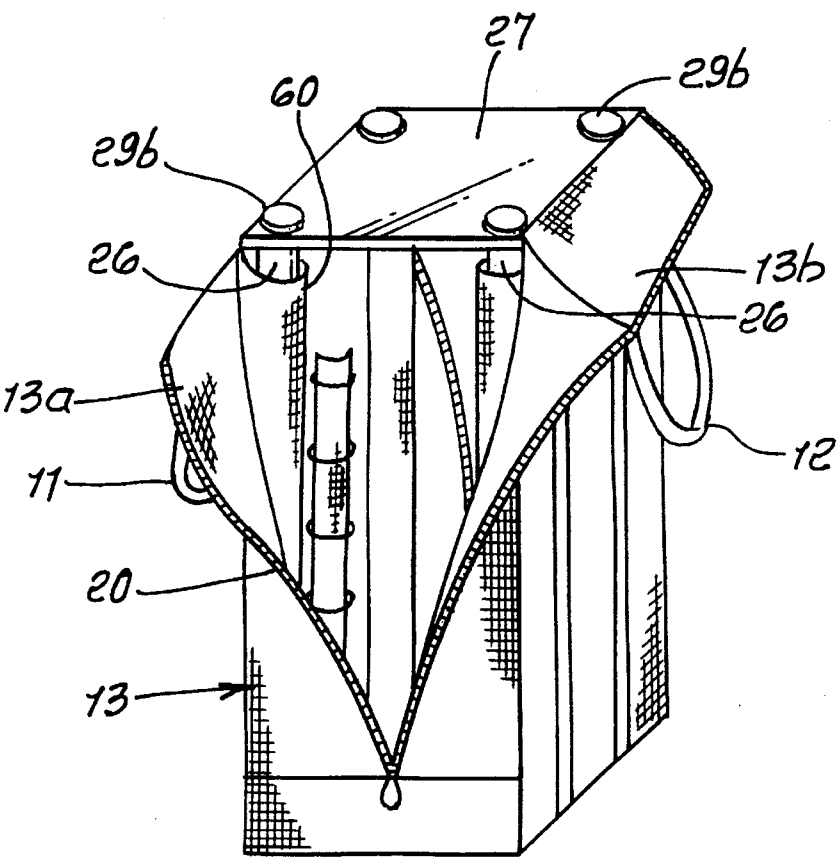
FIG. 2 is a view like FIG. 1, but partly opened up, as by unzipping of a cover.
Figure 1:
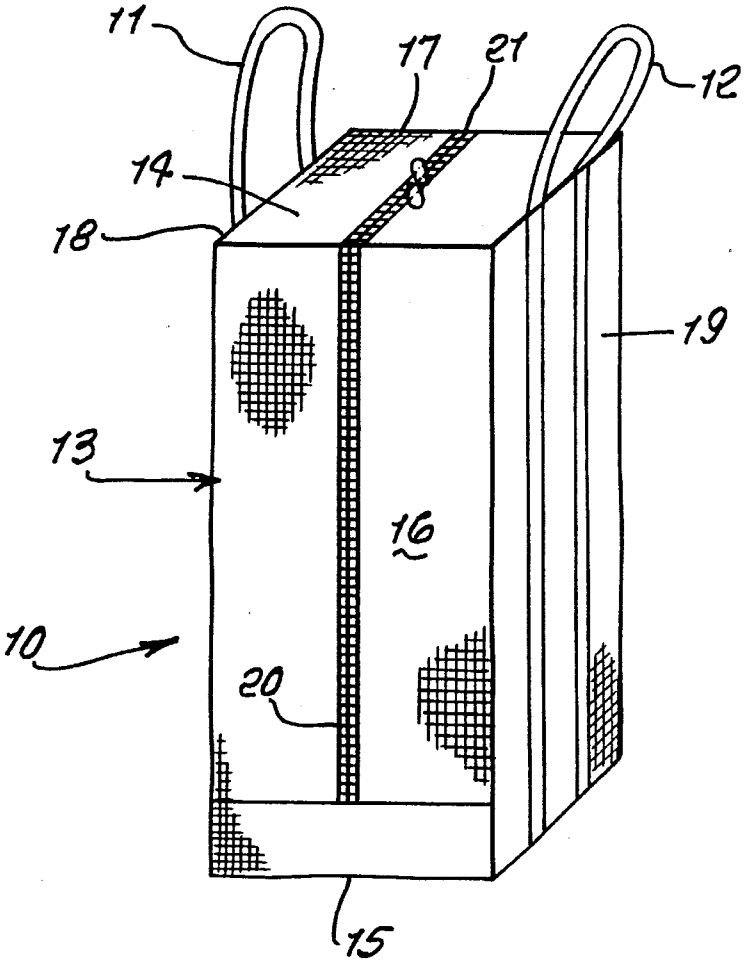
FIG. 1 is a perspective view showing a containment assembly, closed up, with a doll and doll stand inside.
Figure 4:
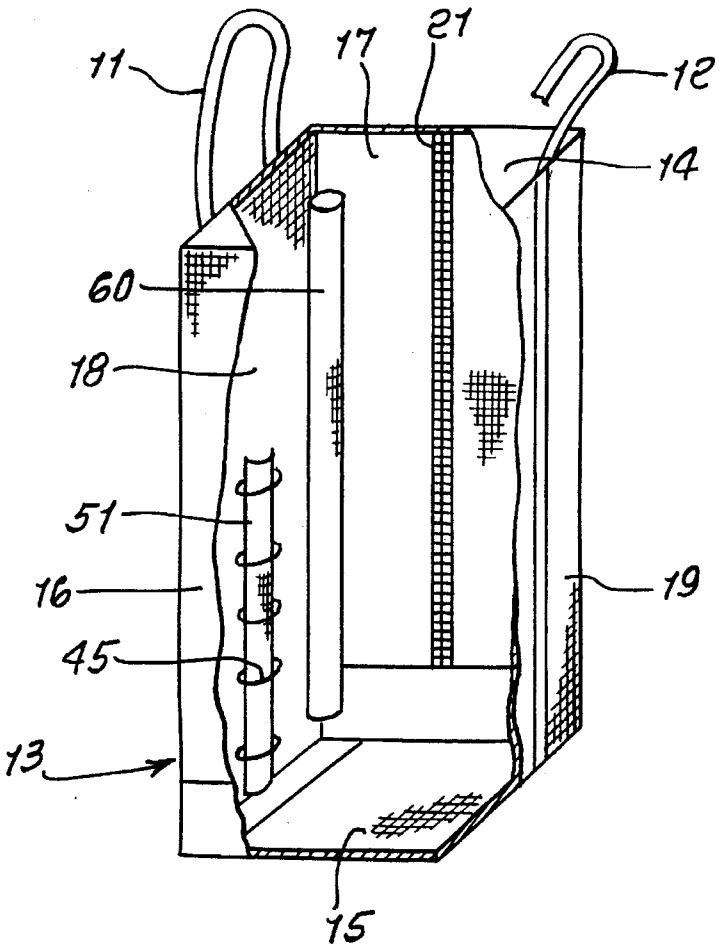
FIG. 4 is another view like FIG. 3, to show cage construction, and doll stand support.

FIG. 1 shows a transporter package assembly 10, in the form of an upright, vertically elongated box, with flexible handles 11 and 12. The package assembly is shown as including a cover 13, which may consist of protective fabric such as waterproof canvas, with top and bottom end walls 14 and 15, and side walls 16–19. Walls 18 and 19 are alike, as are walls 16 and 17. The cover may define an elongated split at locations of an elongated zipper or zippers 20 and 21, one at each of the sides 16 and 17 and meeting at the top wall 14, as shown. The zippers may be unzipped and the cover pulled down in two sections 13*a* and 13*b* as at sides 18 and 19, as shown in FIG. 2, to provide access to the interior of the package, and to a protective cage in that interior, the cage normally interacting with the closed flexible cover to hold the package in "filled out" box shape as seen in FIG. 1.

The cage 22 is so constructed as to protectively contain a doll as on a doll stand 23 (see FIG. 6) positioned within or at the side of the assembly interior 24, and also to be manipulable so as to provide ready access to the contained doll. In its preferred form, the cage comprises laterally spaced, longitudinally elongated members and means holding the ends of said members in fixed position. The members are indicated at 26, and the means to hold the members 26 in laterally spaced, parallel relation preferably comprises top and bottom end plates 27 and 28, the ends of the members 26 removably connected to one or both plates. This allows top plate endwise removal, whereby the person operating the transporter can then reach down into the cage interior to gain access to the doll supported on the doll stand 23, to lift the doll from the stand, as may be desired. Lateral access to the doll and doll stand via spaces between members 26 is also provided.

Figure 6:
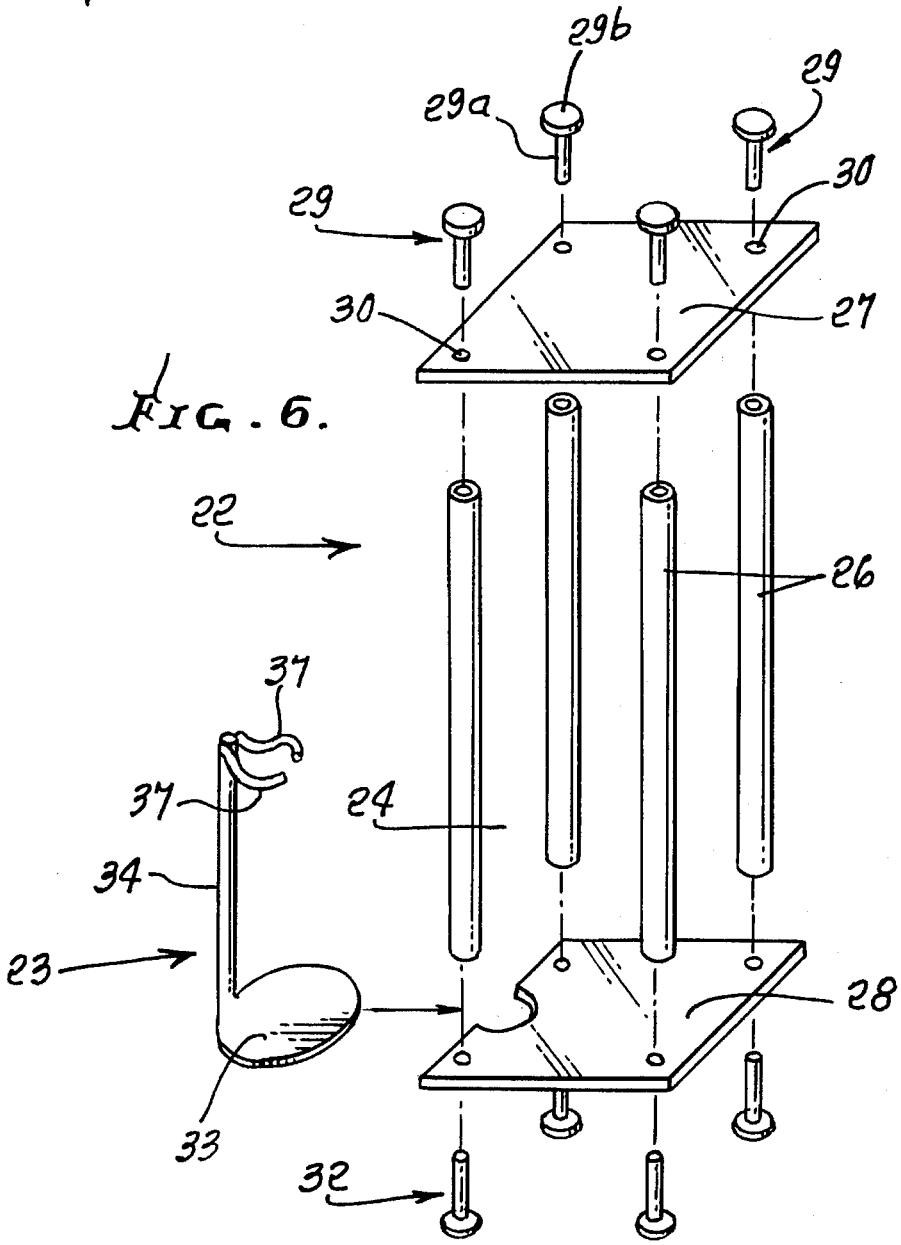
FIG. 6 is an exploded perspective view showing cage tubular members, end plates and connectors in aligned but separated condition, as well as the doll stand.

Removable connection of the top plate to the upper ends of members 26 is shown in FIGS. 6 and 8. Note that the members 26 may be tubular, as for example lightweight plastic (PVC for example) tubes to receive the stub shafts 29*a* of plugs 29. The latter are removably received downwardly through corner holes 30 in the top plate, and into the ends of the tubular members 26. Heads 29*b* on the upper plugs rest on the upper surface of the top plate and are usually held in position by the closed (zippered) upper wall 14 of the fabric cover, as seen in FIG. 1. When the cover is removed as in FIG. 2, the heads 29*b* are exposed, and may be grasped and pulled upwardly to remove them from the members 26 and upper plate. This allows upper plate removal, and downward manual access into the cage interior 24, to grasp the doll. The lower end plate may be similarly connected to the lower ends of members 26, as is clear from FIG. 6. Note lower end plugs 32.

Figure 5:
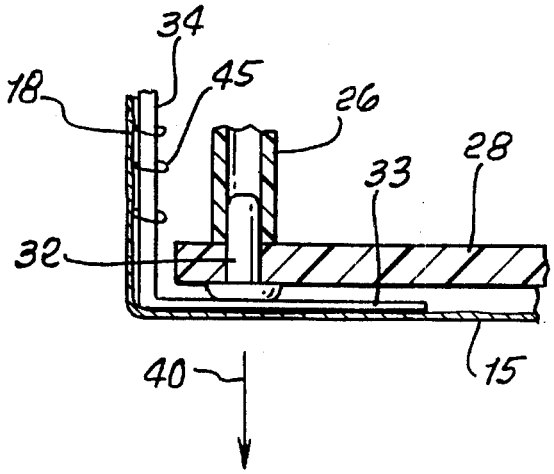
FIG. 5 is an enlarged fragmentary side elevation showing doll stand base confinement adjacent a cage end plate, as by the cover.

FIGS. 5 and 6 show use of the horizontal lower end plate 28 to position the horizontal base 33 of the doll stand 23 adjacent the bottom of that plate, the bottom wall 15 of the cover retaining the base in that position, whereby the doll stand upright part or post 34 is positioned to hold the doll 50, as via grippers 37 on 34 that removably extend about the doll's waist, as is known. See FIG. 10. A sleeve 51 may be carried by wall 18 to extend downwardly over the post 34, to orient the doll vertically, in spaced relation to the cage members. The present invention facilitates positioning of the doll stand, as described, and also enables ready sideward removal of the doll stand from the cage as in the downward direction of arrow 40 in FIG. 5 (when the cover is removed from the cage).

Figure 3:
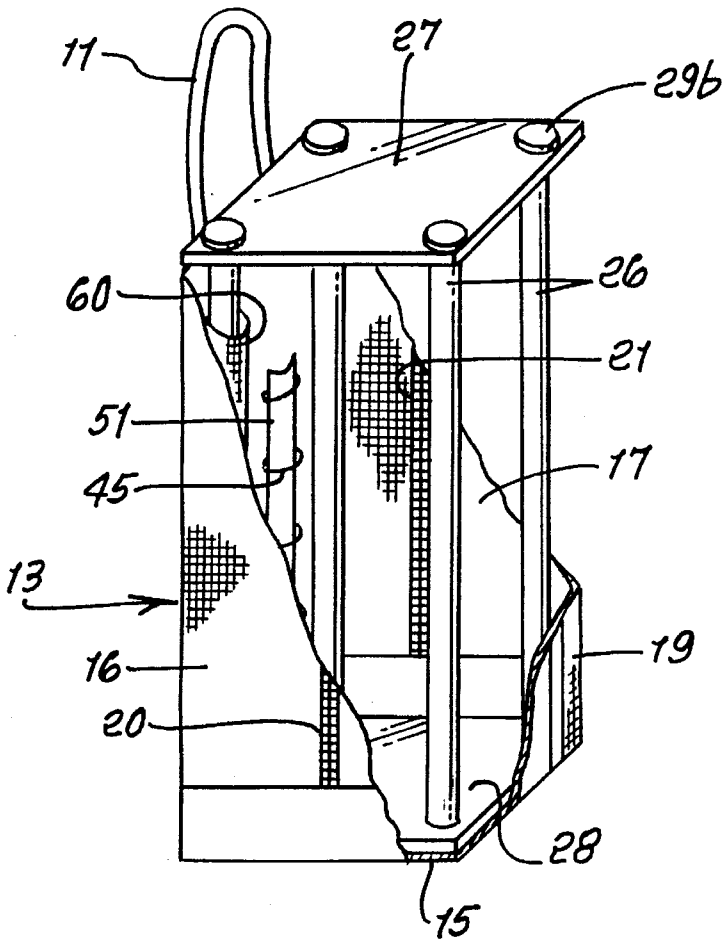
FIG. 3 is a view like FIG. 2, but with the cover partly cut-away to show interior cage construction.

FIG. 3 shows the provision of attachment means such as loops or rings 45 attached to cover side wall 18 and fitting over the post 34, to hold wall 18 adjacent the sleeve 51, thereby holding 33 in position, spaced from the members 26.

FIG. 9 shows the provision of fabric sleeves 60 attached at 61 to interior corner of the cover, and into which the tubular members 26 extend endwise, to hold the posts adjacent the corners of the package cover. Thus, the cover and cage cooperate to mutually position one another, and in spaced relation to the protectively confined and supported doll.

I claim:

1. In a doll transporter, the combination comprising a) a cage comprising laterally spaced, longitudinally elongated members and means holding the ends of said members in fixed position, said means including end plates to which said member ends are connected.

b) a doll stand located to support a doll at the rear thereof and contained within the cage, said stand having a base supported adjacent one of said plates, c) and a cover extending protectively about the cage and to be sufficiently removable therefrom as to provide access to the doll, by manipulation of the cage, said cover holding said base in position adjacent said one plate, said base and plate being generally parallel.

2. The combination of claim 1 wherein said means includes connectors removably connecting member ends to at least one of said plates.

3. The combination of claim 1 including connectors removably connecting member ends to each of said plates.

4. The combination of claim 2 wherein said members are tubular, said plates have holes therethrough, and said connectors have shafts removably extending through said plate holes into said tubular members.

5. The combination of claim 4 wherein said connectors have heads to limit shaft extension into said member.

6. The combination of claim 1 wherein said doll stand has an elongated part carried by the base and extending longitudinally to carry a doll within the cage.

7. The combination of claim 6 including attachment means attaching said part to said cover, to hold the doll and doll stand spaced from said cage members.

8. The combination of claim 7 wherein said attachment means comprises loops attached to the cover and fitting over said part.

9. The combination of claim 1 including sleeves carried by the cover and receiving said members.

10. The combination of claim 9 wherein there are at least three of said members.

11. The combination of claim 9 wherein there are four of said members received in said sleeves, to provide a generally box shaped cage interior space to receive the doll.

12. The combination of claim 1 wherein said cover consists of flexible fabric.

13. The combination of claim 12 wherein the cover has a split portion, and means to releasably close the split.

14. The combination of claim 13 wherein said means comprises at least one zipper, spaced from the cage members.

* * * * *